US011520291B2

(12) United States Patent
Winkler et al.

(10) Patent No.: US 11,520,291 B2
(45) **Date of Patent: *Dec. 6, 2022**

(54) TIMEPIECE RESONATOR COMPRISING AT LEAST ONE FLEXURE BEARING

(71) Applicant: ETA SA MANUFACTURE HORLOGÈRE SUISSE, Grenchen (CH)

(72) Inventors: Pascal Winkler, St-Blaise (CH); Laurent Klinger, Bienne (CH); Jean-Luc Helfer, Le Landeron (CH); Baptiste Hinaux, Lausanne (CH); Gianni Di Domenico, Neuchâtel (CH); Jean-Bernard Peters, Pieterlen (CH)

(73) Assignee: ETA SA MANUFACTURE HORLOGÈRE SUISSE, Grenchen (CH)

( * ) Notice: Subject to any disclaimer, the term of this patent is extended or adjusted under 35 U.S.C. 154(b) by 509 days.

This patent is subject to a terminal disclaimer.

(21) Appl. No.: 16/685,008

(22) Filed: Nov. 15, 2019

(65) Prior Publication Data

US 2020/0192290 A1 Jun. 18, 2020

(30) Foreign Application Priority Data

Dec. 13, 2018 (EP) ..... 18212333

(51) Int. Cl.
*G04B 17/04* (2006.01)

(52) U.S. Cl.
CPC ..... *G04B 17/04* (2013.01)

(58) Field of Classification Search
CPC ..... G04B 17/045; G04B 17/04; G04B 17/06; G04B 15/14; G04B 17/10; G04B 17/28; G04B 17/32
See application file for complete search history.

(56) References Cited

U.S. PATENT DOCUMENTS 9,477,205 B2 * 10/2016 Born ..... G04C 3/101
9,971,303 B2 * 5/2018 Helfer ..... G04B 17/06
(Continued)

FOREIGN PATENT DOCUMENTS

CH 712 068 A2 7/2017
EP 2 975 470 B1 5/2017
(Continued)

OTHER PUBLICATIONS

European Search Report for 18 21 2333 dated May 9, 2019.

*Primary Examiner* — Edwin A. Leon
(74) *Attorney, Agent, or Firm* — Sughrue Mion, PLLC

(57) ABSTRACT

A timepiece resonator including an inertia element suspended from a flexible strip deformable in a plane XY parallel to a longitudinal direction Y, and whose transverse extension along a transverse axis X, in projection onto the plane XY, is variable and of positive value on at least one side of the neutral axis (FN) of the strip, which includes, at a distance from its embedments, at least one rib extending substantially along an axis Z perpendicular to the plane XY, each having at least one generatrix which is farther from the neutral axis (FN) than the external surfaces of the sections of the strip located outside the ribs, and the longitudinal extension (LN) of each rib of the strip, along the longitudinal axis Y, is less than one fifth of the length L of the strip between its embedments.

21 Claims, 7 Drawing Sheets

(56) References Cited

U.S. PATENT DOCUMENTS

| | | | | |
|---|---|---|---|---|
| 10,935,933 | B2 * | 3/2021 | Di Domenico | G04B 17/045 |
| 11,262,702 | B2 * | 3/2022 | Mallet | G04B 17/045 |
| 2016/0011567 | A1 | 1/2016 | Stranczl | |
| 2016/0091862 | A1 | 3/2016 | Born et al. | |
| 2017/0220002 | A1 | 8/2017 | Helfer et al. | |
| 2020/0192291 | A1 * | 6/2020 | Winkler | G04B 17/04 |

FOREIGN PATENT DOCUMENTS

| | | | |
|---|---|---|---|
| EP | 3 001 257 | B1 | 1/2018 |
| EP | 3 299 905 | A1 | 3/2018 |
| WO | 2018/100122 | A1 | 6/2018 |

* cited by examiner

TIMEPIECE RESONATOR COMPRISING AT LEAST ONE FLEXURE BEARING

CROSS-REFERENCE TO RELATED APPLICATIONS

This application claims priority to European Patent Application No. 18212333.1, filed on Dec. 13, 2018, the entire contents of which are incorporated herein by reference.

FIELD OF THE INVENTION

The invention concerns a timepiece resonator comprising, between a first element and a second element of which at least one forms a movable inertia element in said resonator, at least one flexure bearing forming an elastic return means for said inertia element in said resonator and comprising at least one flexible strip joining a first embedment of said first element to a second embedment of said second element, said first embedment defining with said second embedment a strip direction, said first element and said second element each being stiffer than each said at least one flexible strip, said at least one flexible strip being arranged to deform essentially in a plane XY parallel to said strip direction, and having a first dimension L, called the length, along a first longitudinal axis Y parallel to said strip direction, a second direction E, called the thickness, along a second transverse axis X orthogonal to said first axis Y in said plane XY, and a third dimension H, called the height, along a third axis Z orthogonal to said plane XY, said first dimension L being greater than said third dimension H which is greater than said second dimension E, said at least one strip extending substantially in the form of a ribbon around or on either side of a neutral geometric axis joining said first embedment and said second embedment, and comprising at least one median area extending transversely, along said second axis X, on either side of said neutral axis and whose thickness is a nominal thickness EN.

The invention also concerns a timepiece, notably a watch, including at least one such resonator.

The invention concerns the field of timepieces with a mechanical oscillator, and in particular the field of watches, wherein the flexure bearings according to the invention ensure both isochronism and insensitivity to positions in space.

BACKGROUND OF THE INVENTION

Traditionally, a mechanical watch includes an oscillator having a balance/balance spring, which is responsible for ensuring good chronometric precision of the watch.

In brief, the mechanical oscillator fulfils three basic functions, with:

guide means, arranged to limit the degrees of freedom;

inertia means;

elastic return means.

More particularly for the balance/balance spring, these basic functions are performed, respectively, by:

pivots, conventionally in ruby bearings;

the balance rim;

the balance spring.

The precision of traditional mechanical watches is limited by the differences in friction in the balance pivots, according to the different positions that the watch can take in space.

Hence, it is sought to develop oscillators without friction in the pivots.

A very promising approach to the elimination of pivot friction is that of oscillators with flexure bearings, wherein a flexure bearing performs two basic functions at the same time: on the one hand, the guiding function and, on the other hand, the elastic return force or torque function.

In the case of a mechanical watch, a rotary flexure bearing is preferred, so that any translational impact does not disturb the oscillator, and care is taken to place the centre of weight of the inertia element on the virtual axis defined by said flexure bearing.

Non-limiting examples of rotary flexure bearings are disclosed in European Patent documents EP3035126, EP3206089, and EP18179623, all in the name of THE SWATCH GROUP RESEARCH & DEVELOPMENT Ltd. There is now a wide variety of rotary flexure bearings, the manufacture of which was made possible by LIGA and DRIE technologies.

WO Patent document No. 2018/100122A1 in the name of LVMH discloses a device for timepieces comprising a base, an inertia regulating member mounted to rotate with respect to the base, by means of an elastic suspension system connecting the regulating member to the base. The regulating member comprises a number n of stiff parts connected in pairs by means of n elastic coupling connectors. The elastic suspension means includes n elastic suspension connectors individually connecting each stiff part to the base.

European Patent document No. EP3001257A1 in the name of ETA Manufacture Horlogère Suisse discloses a timepiece resonator comprising a weight connected by flexible strips to embedments of a fixed structure, and subjected to a torque and/or a force, this resonator being arranged to oscillate with at least two translational degrees of freedom, and the flexible strips being arranged to maintain the oscillations of the at least one weight about a virtual pivot. These flexible strips include long arms each having a developed length at least two times greater than the shortest distance between the weight and the embedments.

Swiss Patent document No. CH712068A2 in the name of ETA Manufacture Horlogère Suisse discloses a timepiece resonator mechanism with a pivoting weight, pivoting about a virtual axis, and comprising a flexure pivot bearing mechanism and a first and a second fixed support to which there is fixed, by a first resilient assembly and respectively a second resilient assembly which together define this virtual axis, a rotating support carrying this pivoting weight. This flexure pivot bearing mechanism is planar, the first resilient assembly includes, on either side of the virtual axis, a first outer flexible strip and a first inner flexible strip, joined to each other by a first intermediate strip stiffer than each of the latter, together defining a first direction passing through the virtual pivot axis, and the second assembly includes a second flexible strip defining a second direction passing through the virtual pivot axis.

European Patent document No. EP2975470A1 in the name of NIVAROX SA discloses a resilient rotary bearing device for a timepiece mechanism allowing the rotation of one element with respect to another about an axis of rotation defining an axial direction, comprising construction strips, each including an assembly securing part comprising a body and a functional portion extending from the body to one end, the assembly securing part and the functional portion being separated by at least one slot in at least two elastically connected extensions which extend in a radial direction transverse to the axial direction, the device further including anchoring areas disposed at opposite axial ends of the flexure bearing device, and configured to be secured to said members. The assembly securing part of each of the construction strips includes a cavity or an assembly recess and an assembly extension which cross each other, and which fit together in a radial direction to be locked together.

In order to ensure the precision of the mechanical watch, it is sought to define a rotary flexure bearing wherein the return torque is proportional to the angle of elongation, so that the period does not depend on the oscillation amplitude, and wherein the unwanted movements of the centre of virtual rotation are as small as possible, so that the period does not depend on the orientation of the watch. It is also sought to define a bearing that allows large amplitudes without the stresses in the material causing breakage.

In practice, to properly fulfil the guide function of such a flexure bearing, it is known to use at least two flexible strips combined in parallel, such as, for example, in a pivot with strips that cross in projection. However, the most basic form of the rotating flexure bearing is a single strip that works in pure bending mode and which is still a solution that should not be overlooked.

As a first approximation, if a substantially flat strip is subjected to a moment, it deforms in an arc of a circle, and its end defines an angle proportional to the applied moment.

In reality, the bent strip exhibits a slight anticlastic curvature. The anticlastic curvature is due to the fact that the fibres outside the neutral axis of the bending strip must stretch and therefore also contract in directions orthogonal to the neutral axis, and, conversely, the fibres inside the neutral axis contract and therefore extend orthogonally.

The amplitude of these orthogonal deformations is described by the Poisson ratio. If the volume of the material is maintained, the Poisson ratio is 0.5. For most normal materials, the Poisson ratio is closer to the value 0.3.

The amplitude of anticlastic curvature depends on the local bending curvature, the Poisson ratio of the material, ratios between the three main dimensions of the strip, and the geometry of the embedments.

If no precautions are taken, the dependence of anticlastic curvature on the bending angle causes a nonlinearity in the relation between the bending angle and the applied moment.

This effect is very small, but for a mechanical watch oscillator, one thousandth of nonlinearity results in an error on the order of 100 seconds per day of operation.

It should also be noted that it is sometimes sought to control the nonlinearity rather than to eliminate it, in order, for example, to compensate for an anisochronism caused by the escapement used.

SUMMARY OF THE INVENTION

The invention proposes to define a flexure bearing for mechanical oscillators, which is subject to the least possible anticlastic curvature.

The invention proposes to provide the flexible strip with suitable relief, notably ribs, to control the anticlastic curvature, without thereby significantly degrading the elastic performance of the flexible strip.

More particularly, several ribs are arranged along the flexible strip and extend over the height of the latter, in order to stiffen it and limit anticlastic curvature, without significantly limiting its expected bending qualities.

To this end, the invention concerns a timepiece resonator according to claim 1.

The invention also concerns a timepiece, notably a watch, including at least one such resonator.

BRIEF DESCRIPTION OF THE DRAWINGS

Other features and advantages of the invention will appear upon reading the following detailed description, with reference to the annexed drawings, in which:

FIG. 1 is a detail showing the opposing inverse curvatures in the median area of the strip at an equal distance from the embedments.

FIG. 2 is a top view of this strip, and FIG. 3 is a perspective view of this same strip showing the unwanted curvature in the middle of the strip.

FIG. 13: straight parallelepiped ribs over the entire height of the strip, in symmetry with respect to the neutral axis.

FIG. 14: prismatic, diamond-shaped ribs over the entire height of the strip, in symmetry with respect to the neutral axis.

FIG. 15: tubular ribs over the entire height of the strip, in symmetry with respect to the neutral axis.

FIG. 16: prismatic elliptical ribs over the entire height of the strip, in symmetry with respect to the neutral axis.

FIG. 17: straight parallelepiped ribs over the entire height of the strip, alternated with respect to the neutral axis in a regular pitch.

FIG. 18: prismatic, semi-elliptical ribs over the entire height of the strip and on only one side thereof.

FIG. 19: prismatic, trapezium-shaped ribs over the entire height of the strip and on only one side thereof.

FIG. 20: prismatic, sinusoidal wavy ribs over the entire height of the strip, alternated with respect to the neutral axis in a regular pitch and projecting from the neutral axis.

FIG. 21: prismatic ribs in broken zig-zag lines over the entire height of the strip, alternated with respect to the neutral axis in a regular pitch and projecting from the neutral axis.

FIG. 22: prismatic ribs in cylindrical sectors over the entire height of the strip, alternated with respect to the neutral axis in a regular pitch and projecting from the neutral axis.

FIG. 23: prismatic crenelated ribs over the entire height of the strip, alternated with respect to the neutral axis in a regular pitch and projecting from the neutral axis.

FIG. 24: prismatic, sinusoidal wavy ribs over the entire height of the strip, alternated with respect to the neutral axis in a regular pitch and covering the neutral axis.

FIG. 25: prismatic ribs in cylindrical sectors over the entire height of the strip, alternated with respect to the neutral axis in a regular pitch and covering the neutral axis.

FIG. 26: straight parallelepiped ribs over part of the height of the strip, in symmetry with respect to the neutral axis.

FIG. 27: concave strip in symmetry with respect to the neutral axis and with respect to a plane at mid-height of the strip.

FIG. 28: straight parallelepiped ribs over part of the height of the strip, comprising a rounded hollow at mid-height of the strip, in symmetry with respect to the neutral axis.

FIG. 29: straight parallelepiped ribs over part of the height of the strip, comprising a rounded protrusion at mid-height of the strip, in symmetry with respect to the neutral axis.

FIG. 30: straight parallelepiped ribs over part of the height of the strip, on either side of an opening at mid-height of the strip, in symmetry with respect to the neutral axis.

FIG. 31: straight parallelepiped ribs over part of the height of the strip forming upward ramps.

DETAILED DESCRIPTION OF PREFERRED EMBODIMENTS

The invention proposes to provide the flexible strip with relief, and more particularly ribs, to control anticlastic curvature.

Figure 1:
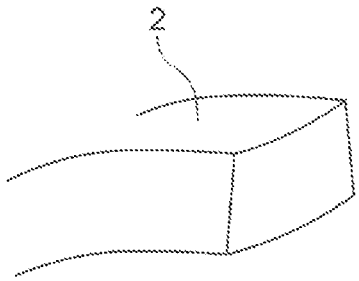
FIGS. 1 to 3 schematically represent a flexible strip subject to anticlastic curvature.
Figure 2:
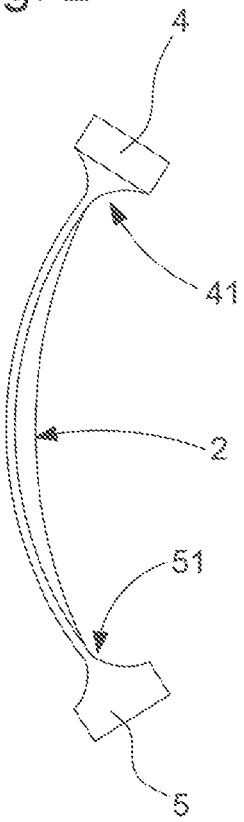
Figure 3:
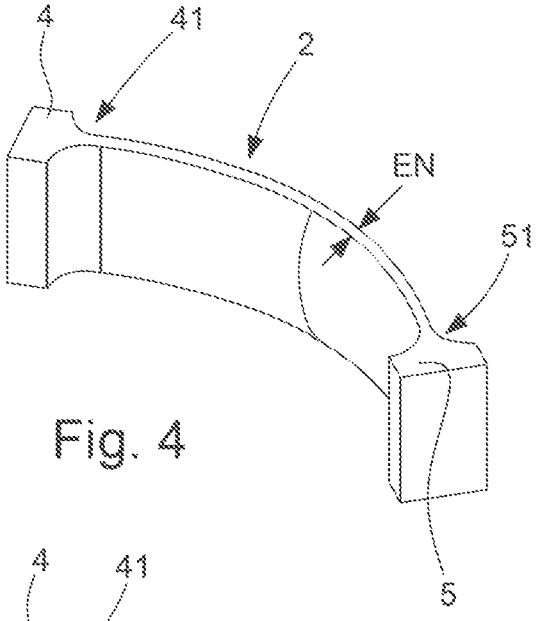

FIGS. 1 to 3 represent a conventional flexible strip subject to anticlastic curvature.

Figure 4:
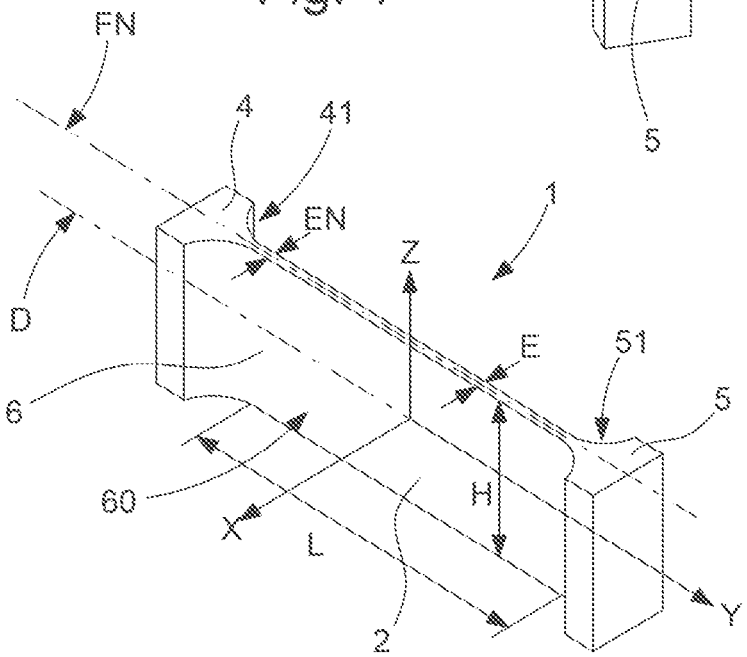
FIG. 4 represents, in a similar manner to FIG. 3, a conventional straight flexible strip between two embedments, in the relaxed, non-tensioned state.

FIG. 4 defines the geometric reference elements used in the following description and represents a flexible strip 2 joining a first embedment 41 of a first element 4 to a second embedment 51 of a second element 5. The first embedment 41 defines with the second embedment 51 a strip direction D. First element 4 and second element 5 are each stiffer than each flexible strip 2. Flexible strip 2 is arranged to deform essentially in a plane XY, parallel to strip direction D, and having a first dimension L, called the length, along a first longitudinal axis Y parallel to strip direction D and defined by first embedment 41 and second embedment 51, a second dimension E, called the thickness, along a second transverse axis X orthogonal to first axis Y in plane XY, and a third dimension H, called the height, along a third axis Z orthogonal to plane XY. First dimension L is greater than third dimension H, which is greater than second dimension E.

Strip 2 extends substantially like a ribbon along a neutral geometric axis FN joining first embedment 41 and second embedment 51, and comprises at least one median area 6, which extends transversely, along second axis X, around or on either side of neutral axis FN, and whose thickness is a nominal thickness EN. Depending on the case, as seen in the Figures, strip 2 can extend around neutral axis FN, which thus remains in the material, or on either side of this neutral axis FN. It is clear that this neutral axis FN corresponds to a curve in the rest position of strip 2, towards which the strip returns after an elastic bending deformation.

Figure 5:
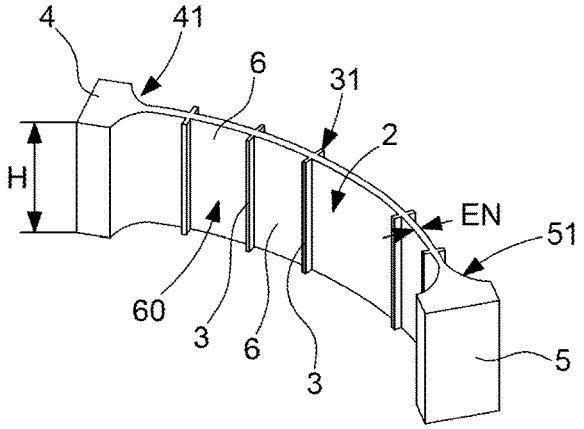
FIGS. 5 and 6 represent, in a similar manner to FIGS. 3 and 2, a flexible strip according to the invention, equipped with ribs extending over its height, shown while bending.
Figure 6:
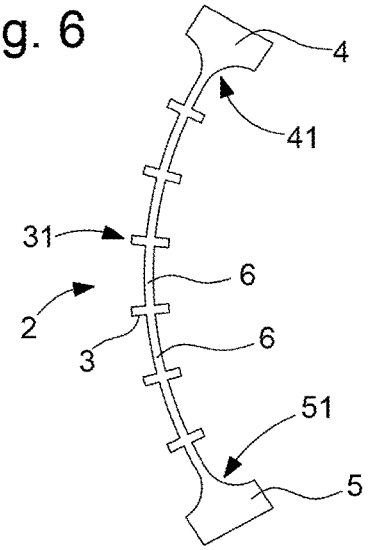

In a variant, as seen in particular in FIG. 5, several ribs are distributed over the strip and extend over the height of the strip, in order to stiffen the strip to limit anticlastic curvature, without stiffening it much for the intended bending.

Figure 7:
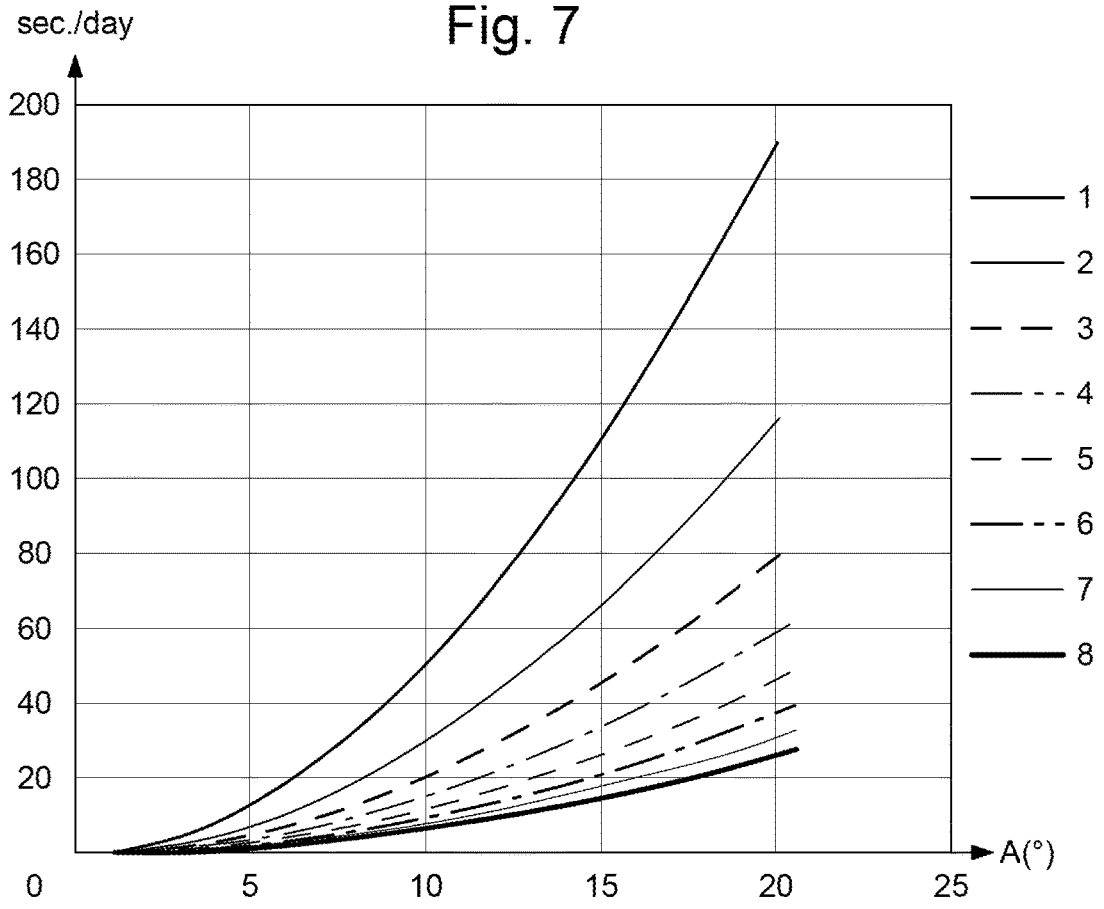
FIG. 7 is a diagram showing the rate of a resonator having a flexure bearing with one strip, with the rate in seconds per day on the ordinate, as a function of its amplitude in degrees on the abscissa, for different numbers of sections between the ribs with which a strip similar to that of FIGS. 5 and 6 is equipped.

FIG. 7 shows the rate of a resonator having a flexure bearing with one strip as a function of its amplitude for different numbers of sections, the number of ribs being equal here to the number of sections minus one. It is observed that the addition of a few ribs is enough to considerably improve the isochronism of the resonator.

Figure 8:
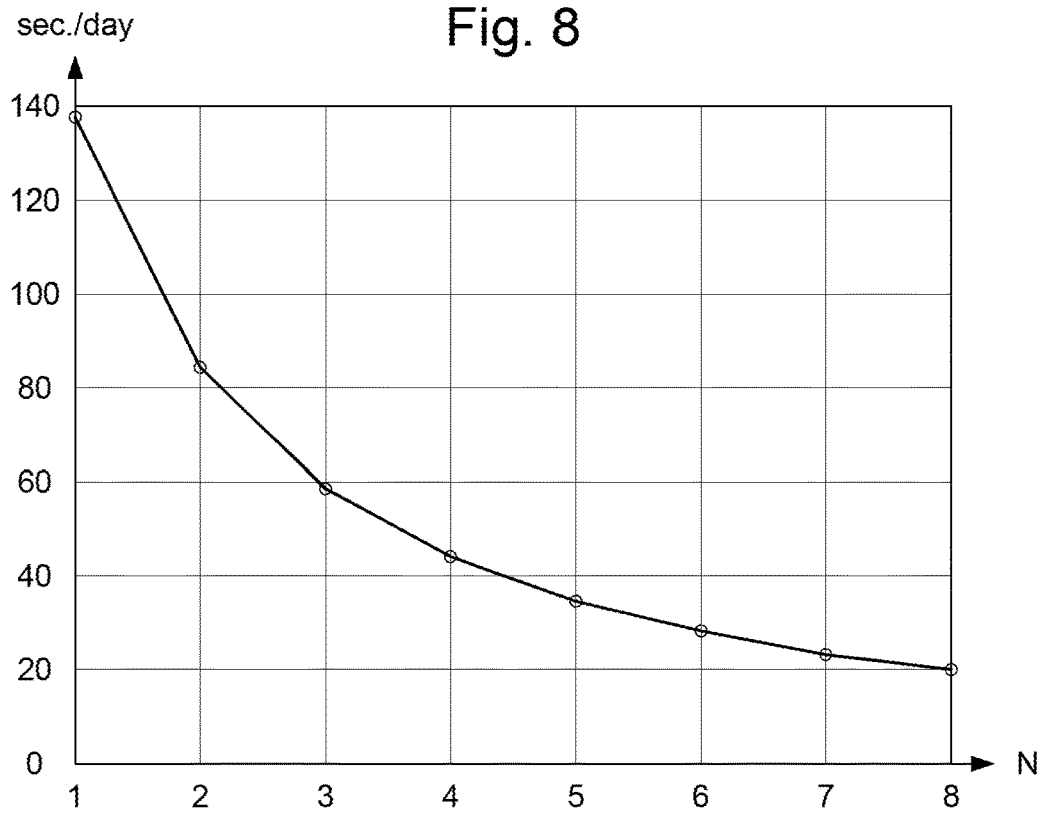
FIG. 8 is a diagram showing the rate of a resonator having a flexure bearing with one strip illustrating its anisochronism, between 20° and 10° amplitude, with the rate in seconds per day on the ordinate, as a function of the number of sections of the resonator strip on the abscissa.
Figures 13, 14, 15, 16, 17, 18, 19:
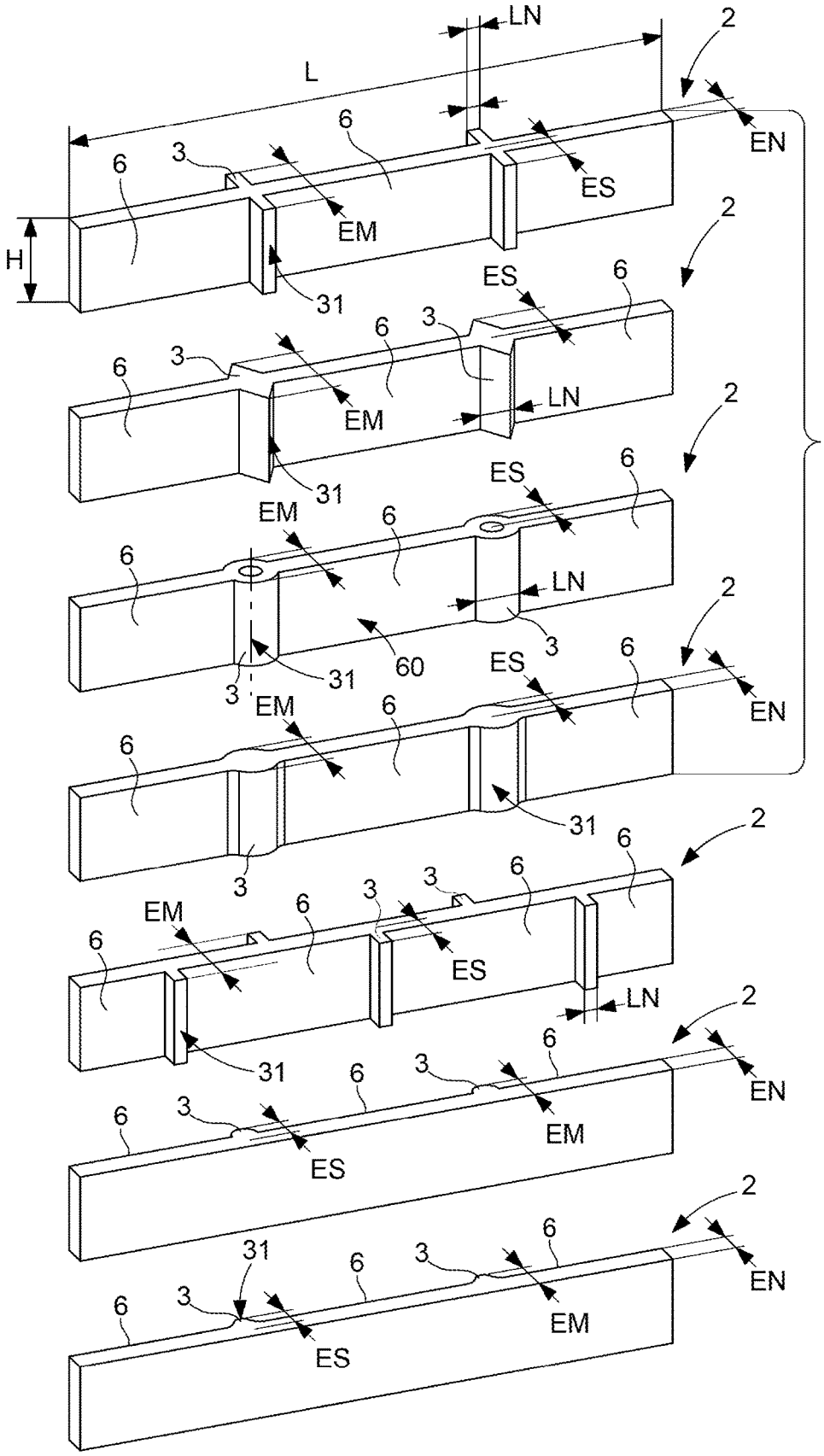
FIGS. 13 to 31 represent, in a similar manner to FIG. 5, different variants of flexible strips according to the invention.
Figure 20:
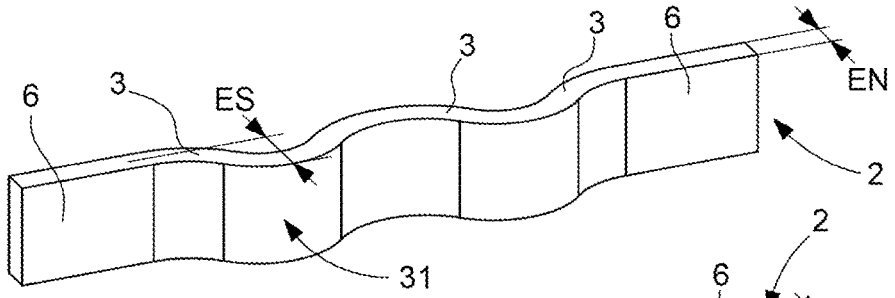
Figure 21:
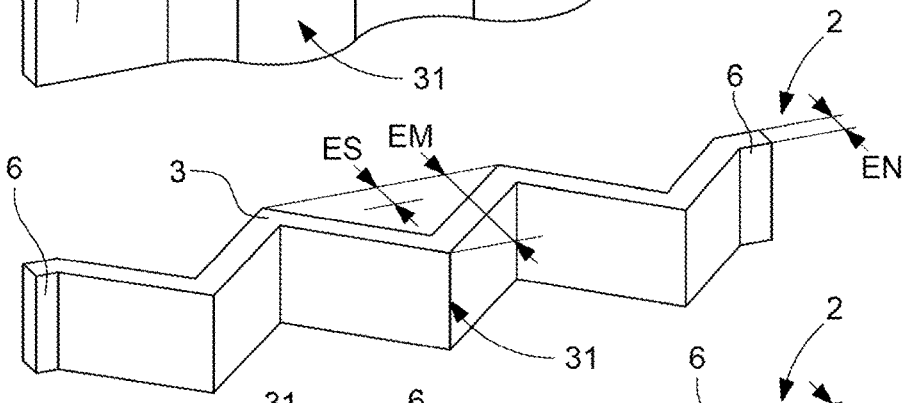
Figure 22:
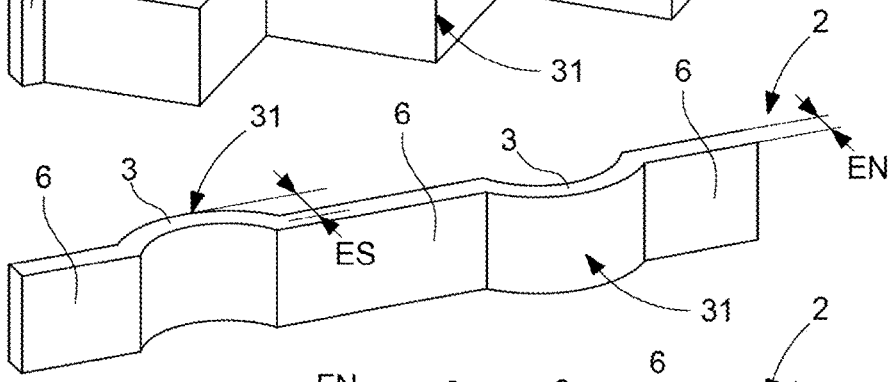
Figure 23:
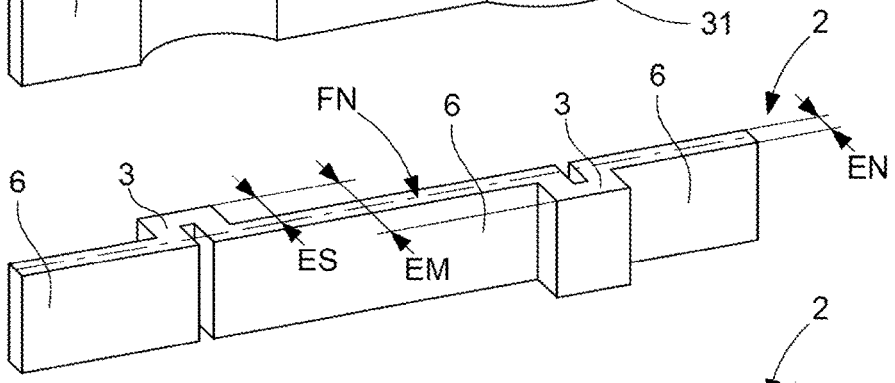
Figure 24:
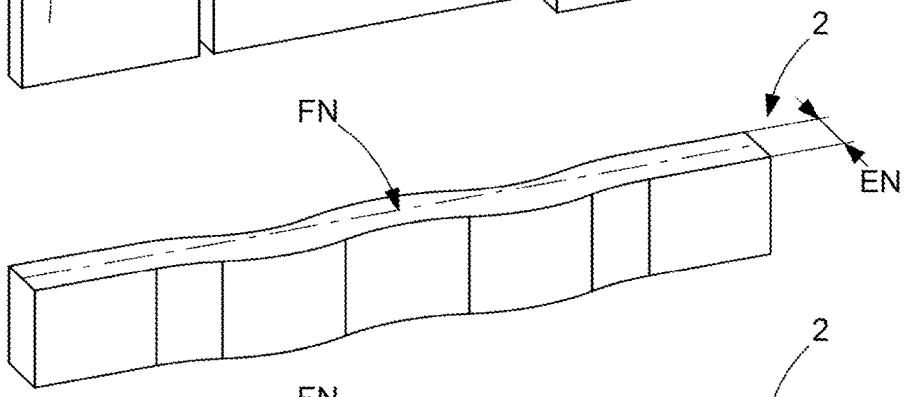
Figure 25:
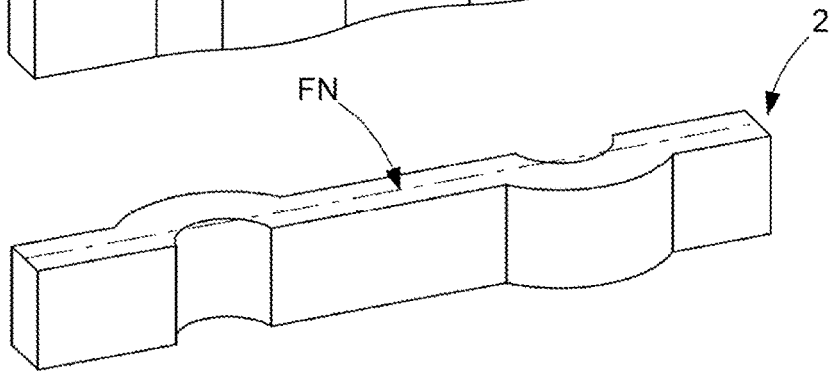
Figure 26:
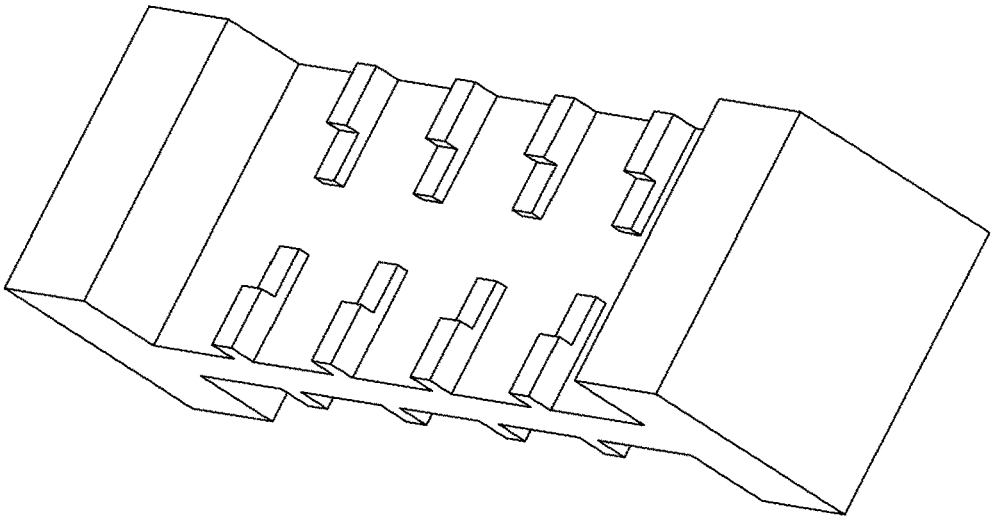
Figure 27:
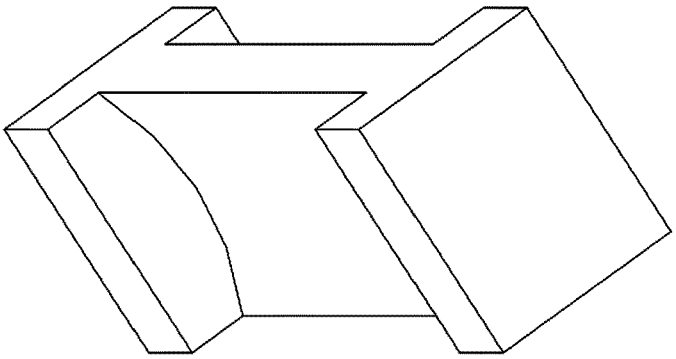
Figure 28:
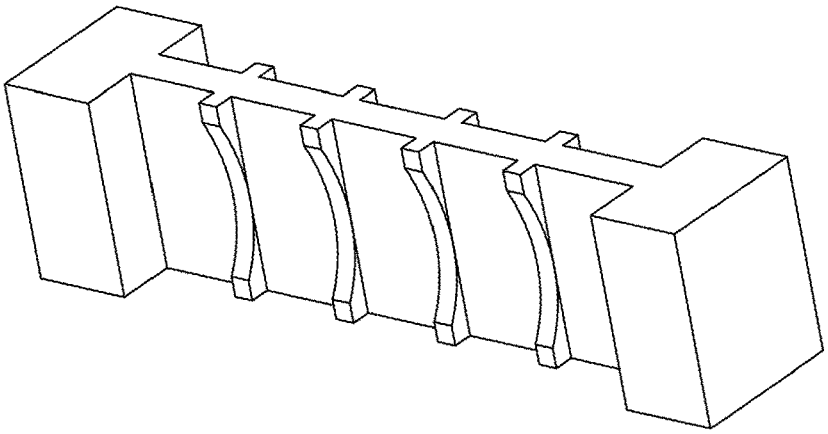
Figure 29:
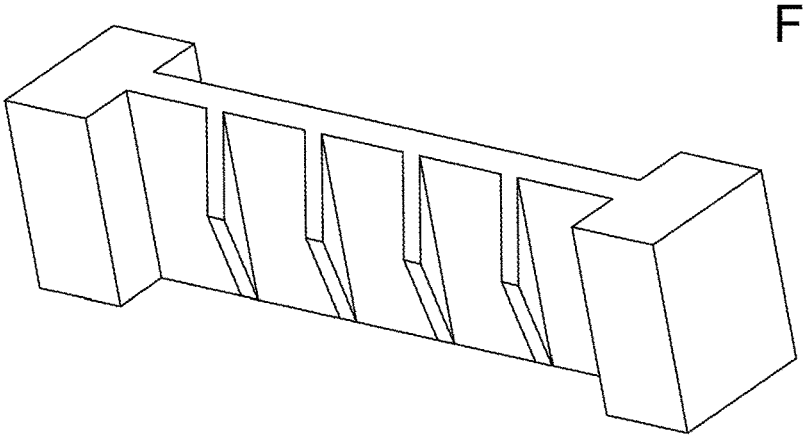
Figure 30:
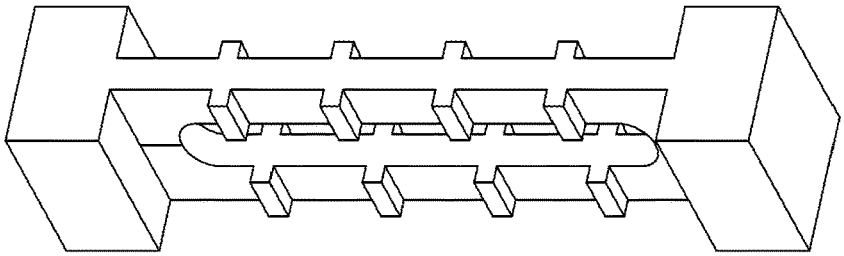
Figure 31:
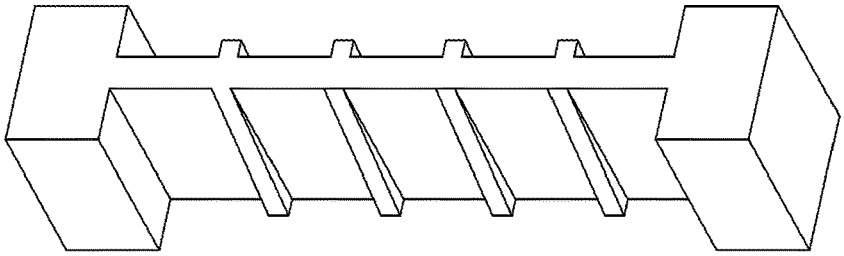
Figure 32:
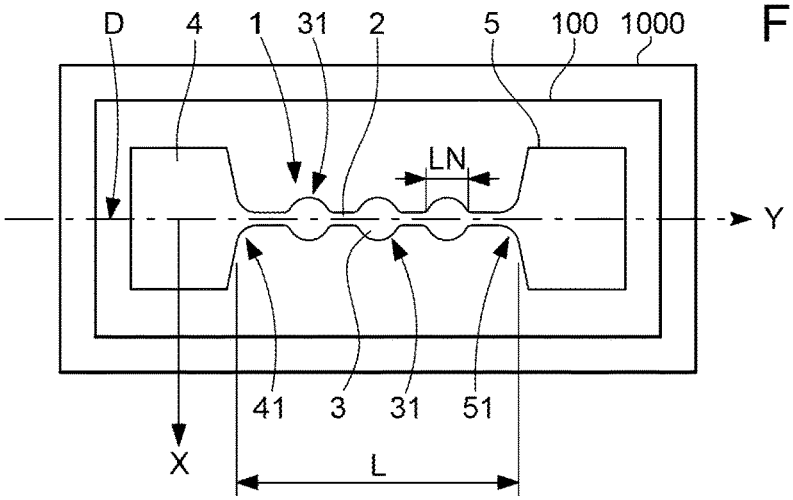
FIG. 32 is a block diagram representing a timepiece, notably a watch, comprising a resonator according to the invention with at least one such flexible strip provided with a relief against anticlastic curvature.

FIG. 8 shows the variation in rate (anisochronism) between 20° and 10° amplitude, as a function of the number of sections of the resonator strip.

Figure 9:
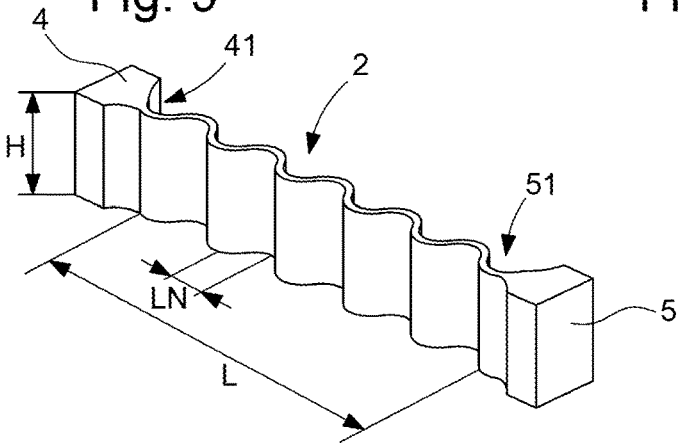
FIGS. 9 and 10 represent, in a similar manner to FIGS. 6 and 5, a flexible strip whose ribs are arranged to form a wavy strip whose neutral axis is not comprised in the thickness of the strip, which strip crosses this neutral axis only in the areas of curvature of the wave.
Figure 10:
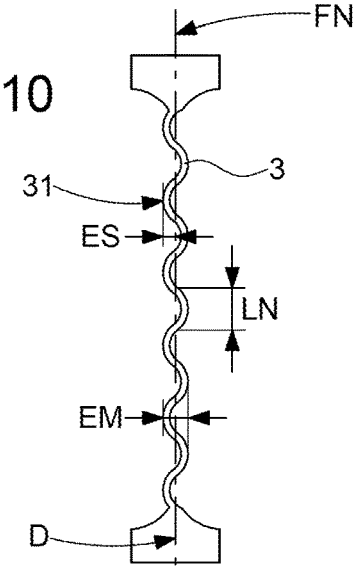
Figure 11:
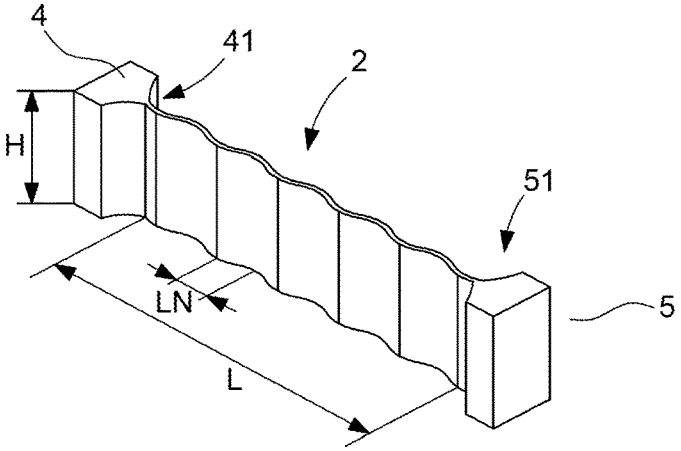
FIGS. 11 and 12 represent, in a similar manner to FIGS. 9 and 10, a flexible strip whose ribs are arranged to form a wavy strip whose neutral axis is comprised in the thickness of the strip, which thus retains its maximum tensile stiffness.
Figure 12:
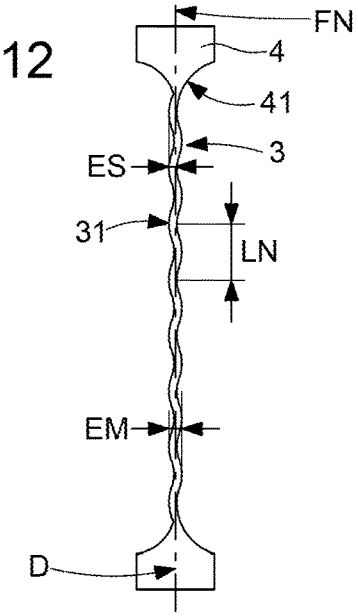

Another variant consists in providing the flexible strip with waves to control the anticlastic curvature, as seen in FIGS. 9 and 10. In projection in plane XY, the proposed wavy strip can completely include neutral axis FN, in order not to lose the tensile stiffness of the strip.

Thus, the invention concerns a timepiece resonator 100 comprising, between a first element 4 and a second element 5 at least one of which forms a movable inertia element in resonator 100, at least one flexure bearing 1 forming an elastic return means for this inertia element in resonator 100.

This flexible bearing 1 includes at least one flexible strip 2 as defined above.

According to the invention, this at least one flexible strip 2 is symmetrical with respect to a median plane parallel to plane XY, has a transverse extension which is variable along second transverse axis X, in projection onto plane XY, with respect to neutral axis FN, and includes, along this second transverse axis X, at least one relief. This relief protrudes and is separated from neutral axis FN by a distance greater than half the smallest thickness of the at least one flexible strip 2 concerned, or half the nominal thickness EN, to limit the anticlastic curvature of this at least one flexible strip 2.

More particularly, this at least one strip 2 includes, at a distance from first embedment 41 and from second embedment 51, at least one rib 3 extending substantially along the third axis Z. Each rib 3 has at least one generatrix 31 which is farther from neutral axis FN than the lateral surfaces of median areas 6 of strip 2 located outside the rib or ribs 3. And the longitudinal extension LN, along first longitudinal axis Y, of each rib 3 of strip 2 is less than or equal to one fifth of the length L of strip 2 between its embedments.

More particularly, each rib 3 is distant, along the first axis Y, from any dip or neck comprised in strip 2, by a value greater than or equal to height H of strip 2. The illustrated variants are strips that do not have a dip or neck.

More particularly, this at least one strip 2 includes a plurality of median areas 6, which are sections extending along neutral axis FN and in the geometric extension of one another along neutral axis FN with the same nominal thickness EN. Each section 6 forms a ribbon whose lateral surfaces 60 are parallel to the third axis Z. And, in projection onto plane XY, at least two sections 6 are separated by a rib 3 of projecting thickness ES with respect to a lateral surface 60. This projecting thickness ES is preferably greater than or equal to nominal thickness EN along the second transverse axis X. More particularly, projecting thickness ES is at least one and a half times greater than nominal thickness EN.

More particularly, this at least one strip 2 includes, at a distance from first embedment 41 and from second embedment 51, at least two ribs 3.

In a particular variant, strip 2 is straight, and includes its straight neutral axis FN in strip direction D.

More particularly, the sections 6 are short sections, whose length in first longitudinal direction Y is less than the height of strip 2.

More particularly, the number of sections is greater than or equal to the first integer number greater than or equal to the ratio L/H of the total length L of strip 2 to its height H.

In a variant, strip 2 includes an alternation of sections 6 along neutral axis FN, and of ribs 3.

In another variant, median areas 6 are limited to bending areas between rounded or pointed ribs, or similar, forming a wavy or zig-zag strip.

In a particular embodiment, this at least one flexible strip 2 includes at least one rib 3 which extends over the entire height H of strip 2 along third axis Z. More particularly, each rib 3 of this strip 2 extends over the entire height H of strip 2 along third axis Z.

More particularly, the height H of strip 2 is less than or equal to one fifth of the length L of strip 2 between its embedments.

More particularly, the maximum thickness EM of strip 2 along the second transverse axis X is less than or equal to one fifth of the height H of strip 2.

In an embodiment that is advantageous in terms of manufacturing, strip 2 forms a right prism extending along third axis Z, i.e. a solid extruded in direction Z from a base in plane XY, and more particularly limited by two planes parallel to plane XY and at a distance from height H. More particularly, the base of this prism in plane XY is symmetrical with respect to the projection of neutral axis FN in plane XY. In other words, strip 2 can easily be made by an extrusion process, or by a LIGA or DRIE process, since its geometry can be entirely described by its projection in plane XY, raised in third direction Z.

In certain illustrated variants, the strip can have a central opening, especially when it is made from two head-to-tail wafers, or include an undercut portion, or two undercut portions in symmetry with respect to a median plane parallel to plane XY.

More particularly, the longitudinal extension LN of each rib 3 of strip 2, along first longitudinal axis Y, is less than or equal to the projecting thickness ES of rib 3 along second transverse axis X.

In a particular embodiment, at least one rib 3 is a rectangular parallelepiped or is inscribed in a rectangular parallelepiped.

More particularly, these rectangular parallelepipeds extend over the entire height of the strip, and their dimension along second transverse axis X is greater than their dimension along first longitudinal axis Y.

In another variant, these ribs are prismatic diamond-shaped ribs, over the entire height of the strip, in symmetry with respect to the neutral axis through which a diagonal of the diamond passes.

In a particular embodiment, at least one rib 3 is a cylinder.

In a particular embodiment, at least one said rib 3 is a tube of circular or elliptical cross-section.

In a particular embodiment, at least one rib is symmetrical with respect to the neutral axis FN.

In a particular embodiment, at least one rib is asymmetrical with respect to the neutral axis FN.

In a particular embodiment, strip 2 includes, at a distance from first embedment 41 and from second embedment 51, a plurality of ribs 3 alternately protruding on either side of median areas 6.

In a particular embodiment, at least one rib 3 is hollow or open.

In a particular embodiment, any projection of strip 2 onto plane XY encompasses neutral axis FN.

In a particular embodiment, strip 2 includes, at a distance from first embedment 41 and from second embedment 51, a plurality of ribs 3 regularly distributed along the first longitudinal direction Y.

In a particular embodiment, strip 2 includes, at a distance from first embedment 41 and from second embedment 51, a plurality of ribs 3, the number of which is greater than or equal to the difference between, on the one hand, the ratio L/H between length L and height H, and on the other hand, one unit.

In a particular embodiment, the projection of strip 2 onto plane XY includes, at all the surface junctions, rounded fillets with a minimum radius value of 10 micrometres.

In a particular embodiment, strip 2 is made of micromachinable material or of silicon temperature-compensated with a peripheral layer of silicon dioxide.

More particularly, strip 2 includes, along its length L, at least two increases in its sectional inertia. In a particular embodiment, the strip has at least three increases in sectional inertia. These increases in sectional inertia are made by ribs 3 which extend in third direction Z.

In a "corrugated sheet" variant, these increases in sectional inertia are made by waves which extend on either side of the neutral axis.

In an "inextensible sheet" variant, the increases in sectional inertia are made by such waves which, seen in projection onto plane XY, include the neutral axis.

The actual flexure bearing 1 is not detailed here. More particularly, it comprises at least two such flexible strips 2. More particularly, this flexure bearing is a cross strip pivot, with at least two distinct strips each extending parallel to plane XY and crossed in projection onto this plane XY.

More particularly, strip 2 is made by a DRIE or LIGA or similar process.

The invention also concerns a timepiece 1000 including at least one such timepiece resonator 100. More particularly, this timepiece 100 is a watch, in particular a mechanical watch.

The invention claimed is:

1. A timepiece resonator (100) comprising, between a first element (4) and a second element (5) of which at least one forms a movable inertia element in said resonator (100), at least one flexure bearing (1) forming an elastic return means for said inertia element in said resonator (100) and comprising at least one flexible strip (2) joining a first embedment (41) of said first element (4) to a second embedment (51) of said second element (5), said first embedment (41) defining with said second embedment (51) a strip direction (D), said first element (4) and said second element (5) each being stiffer than each said at least one flexible strip (2), said at least one flexible strip (2) being arranged to deform in a plane XY, parallel to said strip direction (D), and having a first dimension L, corresponding to a length, along a first longitudinal axis Y parallel to said strip direction (D) a second dimension E, corresponding to a thickness, along a second transverse axis X orthogonal to said first axis Y in said plane XY, and a third dimension H, corresponding to a height, along a third axis Z orthogonal to said plane XY, said first dimension L being greater than said third dimension H which is greater than said second dimension E, said at least one strip (2) extending like a ribbon around or on either side of a geometric neutral axis (FN) joining said first embedment (41) and said second embedment (51), and comprising at least one median area (6) extending transversely along said second axis X, on either side of said neutral axis (FN) and whose thickness is a nominal thickness EN, wherein said at least one flexible strip (2) is symmetrical with respect to a median plane parallel to said plane XY, has a variable transverse extension with respect to said neutral axis (FN), along said second transverse axis X, in projection onto the plane XY, and comprises, along said second transverse axis X, at least one relief which protrudes and is separated from said neutral axis (FN) by a distance greater than half a smallest thickness of said at least one flexible strip (2) or half said nominal thickness (EN), to limit anticlastic curvature of said at least one flexible strip (2), and wherein said strip (2) comprises, at a distance from its embedments, at least one rib (3) extending along an axis Z perpendicular to the plane XY, wherein said strip (2) includes, at a distance from said first embedment (41) and from said second embedment (51), at least two ribs (3).

2. The timepiece resonator (100) according to claim 1, wherein each said rib (3) has at least one generatrix (31) which is farther from said neutral axis (FN) than the lateral surfaces of said median areas (6) of said strip (2) located outside said ribs (3), and wherein the longitudinal extension LN, along said first longitudinal axis Y, of each said rib (3) of said strip (2) is less than or equal to one fifth of said length L of said strip (2) between its embedments.

3. The timepiece resonator (100) according to claim 1, wherein each said rib (3) is distant, along said first axis Y, from any dip or neck comprised in said strip (2), by a value greater than or equal to said height H of said strip (2).

4. The timepiece resonator (100) according to claim 1, wherein said at least one strip (2) includes a plurality of said median areas (6), which are sections extending along said neutral axis (FN) and in the geometric extension of one another along said neutral axis (FN) with the same said nominal thickness EN, each said section (6) forming a ribbon whose lateral surfaces (60) are parallel to said third axis Z, wherein, in projection onto said plane XY, at least two said sections (6) are separated by a said rib (3) of projecting thickness ES with respect to a said lateral surface (60), said projecting thickness ES being greater than or equal to said nominal thickness EN along said second transverse axis X.

5. The timepiece resonator (100) according to claim 1, wherein said at least one strip (2) includes a plurality of said median areas (6), which are sections extending along said neutral axis (FN) and in the geometric extension of one another along said neutral axis (FN) with the same said nominal thickness EN, each said section (6) forming a ribbon whose lateral surfaces (60) are parallel to said third axis Z, wherein, in projection onto said plane XY, at least two said sections (6) are separated by a said rib (3) of projecting thickness ES with respect to a said lateral surface (60), said projecting thickness ES being greater than or equal to said nominal thickness EN along said second transverse axis X, and wherein said projecting thickness ES is at least one and a half times greater than said nominal thickness EN.

6. The timepiece resonator (100) according to claim 1, wherein said strip (2) is straight and has its said straight neutral axis (FN) along said strip direction (D).

7. The timepiece resonator (100) according to claim 1, wherein said at least one flexible strip (2) comprises at least one said rib (3) which extends over an entire said height H of said strip (2) along said third axis Z.

8. The timepiece resonator (100) according to claim 1, wherein said height H of said strip (2) is less than or equal to one fifth of said length L of said strip (2) between its embedments.

9. The timepiece resonator (100) according to claim 1, wherein a maximum thickness EM of said strip (2) along said second transverse axis X is less than or equal to one fifth of said height H of said strip (2).

10. The timepiece resonator (100) according to claim 1, wherein said strip (2) forms a right prism extending along said third axis Z.

11. The timepiece resonator (100) according to claim 1, wherein said strip (2) forms a right prism extending along said third axis Z, and wherein the base of said prism in said plane XY is symmetrical with respect to the projection of said neutral axis in said plane XY.

12. The timepiece resonator (100) according to claim 1, wherein the longitudinal extension LN of each said rib (3) of said strip (2), along said first longitudinal axis Y, is less than or equal to the projecting thickness ES of said rib (3) along said second transverse axis X.

13. The timepiece resonator (100) according to claim 1, wherein at least one said rib (3) is a rectangular parallelepiped or is inscribed in a rectangular parallelepiped.

14. The timepiece resonator (100) according to claim 1, wherein at least one said rib (3) is symmetrical with respect to said neutral axis (FN).

15. The timepiece resonator (100) according to claim 1, wherein said strip (2) includes, at a distance from said first embedment (41) and from said second embedment (51), a plurality of said ribs (3) alternately protruding on either side of said median areas (6).

16. The timepiece resonator (100) according to claim 1, wherein any projection of said strip (2) onto said plane XY encompasses said neutral axis FN.

17. The timepiece resonator (100) according to claim 1, wherein said strip (2) includes, at a distance from said first embedment (41) and from said second embedment (51), a plurality of said ribs (3) regularly distributed along said first longitudinal direction Y.

18. The timepiece resonator (100) according to claim 1, wherein said strip (2) includes, at a distance from said first embedment (41) and from said second embedment (51), a plurality of said ribs (3), the number of which is greater than or equal to a difference between a ratio L/H between said length L and said height H, and one unit.

19. The timepiece resonator (100) according to claim 1, wherein the projection of said strip (2) onto said plane XY includes, at all the surface junctions, rounded fillets with a minimum radius value of 10 micrometres.

20. The timepiece resonator (100) according to claim 1, wherein said strip (2) is made of micromachinable material or of silicon temperature-compensated with a peripheral silicon dioxide layer.

21. A timepiece (1000) including at least one timepiece resonator (100) according to claim 1.

* * * * *